US005228508A

United States Patent [19]

Facteau et al.

[11] Patent Number: 5,228,508

[45] Date of Patent: Jul. 20, 1993

[54] PERFORATION CLEANING TOOLS

[76] Inventors: David M. Facteau, 2601 Emerson, Midland, Tex. 79705; Timothy A. Cobb, 1416 Sierra Springs, #1815, Bedford, Tex. 76021; Michael D. Hyman, 2206 Madera, Odessa, Tex. 79763

[21] Appl. No.: 887,846

[22] Filed: May 26, 1992

[51] Int. Cl.[5] ..... E21B 37/08

[52] U.S. Cl. ..... 166/177; 166/222; 166/312

[58] Field of Search ..... 166/249, 177, 312, 222

[56] References Cited

U.S. PATENT DOCUMENTS

| | | | |
|---|---|---|---|
| 2,437,456 | 3/1948 | Bodine, Jr. | 166/177 X |
| 3,520,362 | 7/1970 | Galle | 166/177 X |
| 3,730,269 | 5/1973 | Galle | 166/177 |
| 3,842,907 | 10/1974 | Baker et al. | 166/249 |
| 3,850,135 | 11/1974 | Galle | 166/249 X |
| 4,280,557 | 7/1981 | Bodine | 166/177 |
| 4,630,689 | 12/1986 | Galle et al. | 175/56 |
| 4,673,037 | 6/1987 | Bodine | 166/177 |

*Primary Examiner*—Stephen J. Novosad
*Attorney, Agent, or Firm*—Bush, Moseley & Riddle

[57] ABSTRACT

In accordance with illustrative embodiments of the present invention, a well perforation cleaning tool includes a fluidic oscillator that creates pressure pulsations which induce cyclical stresses in the walls of the perforations and causes damaged skins thereon to disintegrate in order to improve the productivity of the well. The output passages of one embodiment of the fluidic oscillator are connected to respective internal storage cavities and each cavity is communicated with the annulus by a pair of outlet passages. In other embodiments, relatively short length external cavities communicate with the output passages to provide means by which the pressure pulsations are conveyed to the well annulus. Cylindrical filter tubes having a plurality of sets of axially spaced slots are adjustably mounted at the upper and lower ends of the tool may, if desired, be used to provide resistances which substantially confine the pressure pulsations to the immediate vicinity of the tool body. Both tubing conveyed and coil tubing conveyed tools are disclosed.

15 Claims, 2 Drawing Sheets

FIG. 1
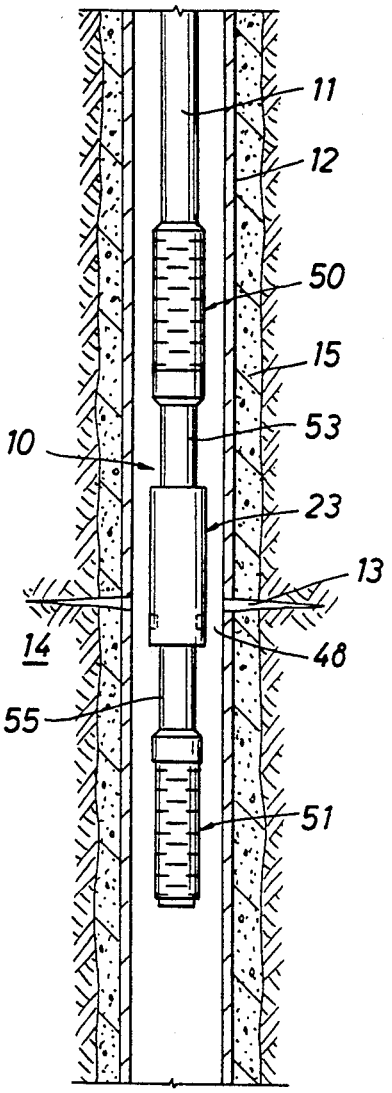
FIG. 2
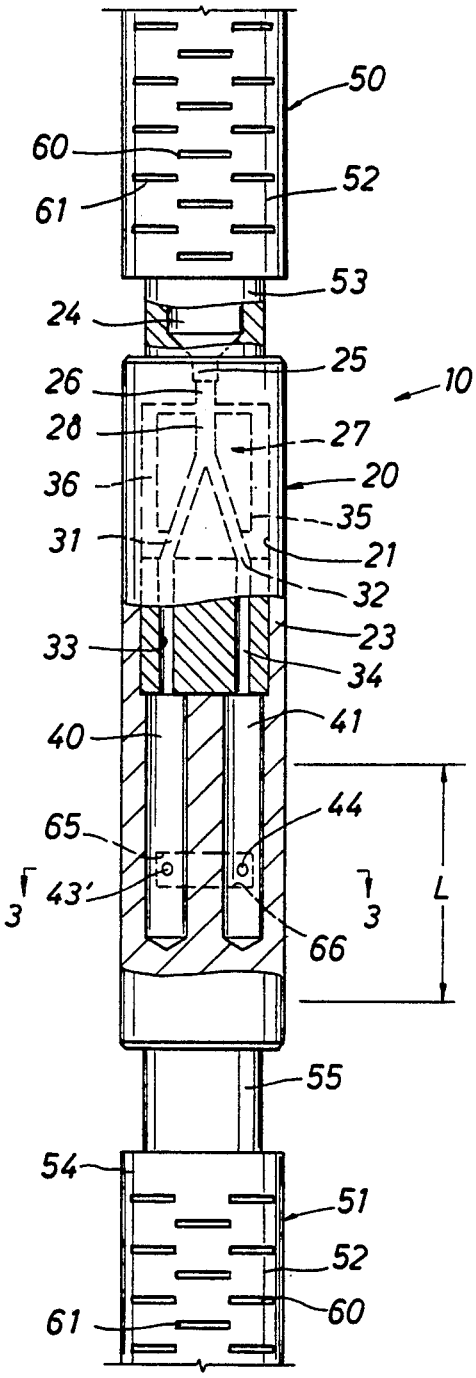
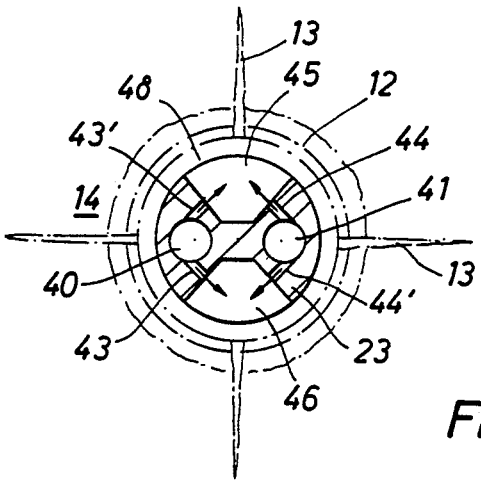
FIG. 3

PERFORATION CLEANING TOOLS

FIELD OF THE INVENTION

This invention relates generally to tools for cleaning oil well perforations using pressure pulsations and particularly to new and improved perforation cleaning tools where the pressure pulsations are confined to a relatively small volume of the well bore outside the tool to yield improved disintegration of an impermeable skin of the perforation and thus increase the production capability of the well.

BACKGROUND OF THE INVENTION

A cleaning tool that uses a fluidic oscillator to create pressure fluctuations in the well bore adjacent a perforated interval to clean the perforations has been proposed. See SPE Paper No. 13803 entitled "Pressure Fluctuating Tool" by Payne, Williams, Petty and Bailey. Patents which are related to this technique are Galle U.S. Pat. No. 3,520,362, Galle U.S. Pat. No. 3,730,269, Baker et al U.S. Pat. No. 3,842,907, Galle U.S. Pat. No. 3,850,135 and Galle U.S. Pat. No. 4,630,689. The pulses that are created by the fluidic oscillator are fed to respective fluid-filled chambers that are communicated by an inertia tube. Oscillating or fluctuating pressures are thus generated in the annular space between the tool and the casing wall which disturb the walls of the perforations. Acoustic filters in the form of gas-filled rubber bladders are positioned in the tool above and below the primary oscillation zone to limit the propagation of the acoustic signals up and down the well bore, and to concentrate the pressure fluctuations to an adjacent interval of the perforations. The pressure fluctuations are said to remove debris from the perforations and pulverize any impermeable skin on the wall of the perforation tunnels, which can be caused by current methods of shaped charge perforating. Oil production from the perforations is thereby increased, and the ability to stimulate the formation using various techniques is also enhanced.

U.S. application Ser. No. 716,262 filed Jun. 17, 1991, now U.S. Pat. No. 5,135,051, and entitled "Perforation Cleaning Tool" in which we also are named as joint inventors, represents an improvement of the devices shown in the above-mentioned patents by providing new and improved tubular filters with transverse slots that inhibit fluid movement to better confine the pressure fluctuations to that region of the well bore between the filters. These filters provide particularly improved operation respecting those prior devices that have the elastomer bladder filters, in that they enable a shorter and smaller size tool to be used. This tool is easier to handle and does not require a large vehicle to transport it to and from a job site. The tool also has an outer diameter such that it can be operated in well casings having a fairly small size so as to work in a range of sizes that are found in most oil producing areas.

The tools shown in the above-mentioned publication and prior patents have yet another shortcoming in that the pressure fluctuations are not particularly concentrated in a manner to provide optimum cleaning of the perforations adjacent thereto. The prior devices typically employ spaced upper and lower exit ports which communicate with the outside of a small diameter sub that defines the inner wall of an exterior acoustic tank which is generally coextensive with the length of the sub. The volume of this exterior tank is so large that the intensity of the pressure fluctuations is attenuated, which reduces the cleaning power.

The general object of the present invention is to provide new and improved perforation cleaning tools where pressure fluctuations are concentrated in a much smaller volume to provide a more intense cleaning action.

Still another object of the present invention is to provide new and improved tools of the type described that produce more concentrated pressure fluctuations, in combination with an acoustic filter system that can be adjusted to fine-tune or calibrate the tool for maximum efficiency.

Yet another object of the present invention is to provide a new and improved tool of the type described which can be run and located adjacent the perforations to be cleaned without removing the production tubing from the well.

SUMMARY OF THE INVENTION

These and other objects are attained in accordance with the concepts of the present invention through the provision of a perforation cleaning tool that contains a fluidic oscillator which is supplied with an operating liquid through a running string on which the tool is suspended. In one embodiment, the oscillator provides back and forth switching of fluid flow through its different legs that provides alternating pressure waves to separate storage cavities. The pressure pulses in the cavities are released into the well annulus via four outlet legs, two extending from each cavity. The construction and arrangement is such that the annular volume between the tool and the casing in the region of the outlet legs is relatively small, which concentrates the pressure fluctuations in a manner that damaging skins that may be clogging the walls of the perforations are pulverized. The pulsating pressures also are contained by upper and lower filters that are connected to the respective opposite ends of the tool body. These filters, which function to substantially block the transmission of acoustic waves up or down the casing, each include an elongated tubular member that is mounted on a sub that is connected to the tool body. A series of narrow, axially spaced, transverse slots are formed through the walls of each tubular member which provide resistances to fluid flow, and in so doing limit the length of the energy zone to the cleaning interval. Each of these filters is axially adjustable with respect to the body to fine-tune or calibrate the tool for maximum efficiency and optimum operation.

In another embodiment of the present invention, the tool has a small outer diameter so that it can be run into the well through the production string on coil tubing or the like. Oscillation blocks having different outlet configurations are used to achieve optimum cleaning results.

BRIEF DESCRIPTION OF THE DRAWINGS

The present invention has other objects, features and advantages which will become more clearly apparent in connection with the following detailed description of a preferred embodiment, taken in conjunction with the appended drawings in which:

FIG. 1 is a schematic view showing the perforation cleaning tool of the present invention operating in a cased and perforated well bore;

FIG. 2 is a longitudinal sectioned view, with some portions in side elevation, of the perforation cleaning tool of FIG. 1;

FIG. 3 is a cross-section on line 3—3 of FIG. 2;

DETAILED DESCRIPTION OF A PREFERRED EMBODIMENT

Figure 4:
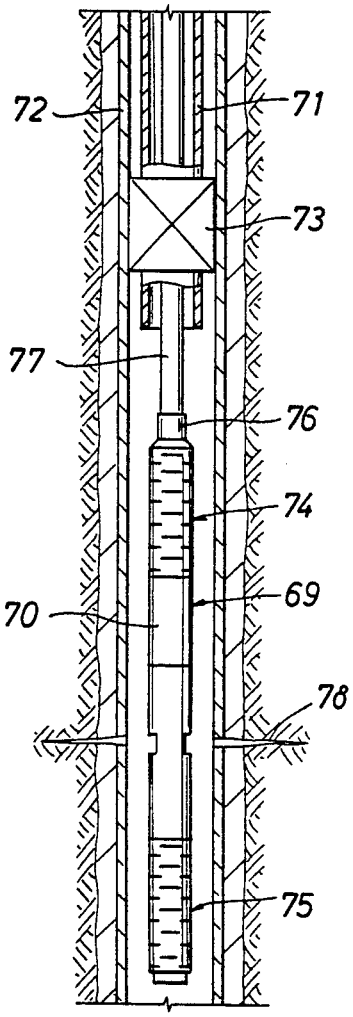
FIG. 4 is a view similar to FIG. 2 of a small diameter tool adapted for through-tubing perforation cleaning.

Referring initially to FIG. 1, a perforation cleaning tool 10 that is constructed in accordance with the present invention is shown suspended on a running string 11 of tubing that extends upward to the surface. The tool 10 has been lowered into a well casing 12 until it is located opposite an interval of perforations 13 that are to be cleaned. The perforations 13 are formed by conventional means such as shaped charges to provide a plurality of radially extending, generally carrot-shaped tunnels through which oil and/or gas from the formation 14 enters the well casing 12.

The explosion of a shaped charge penetrates the casing wall, the cement sheath 15, and fairly deeply into the rock of the formation 14. The extremely high energy by which a perforation 13 is formed often produces a "skin" on the walls of the tunnel which is substantially impermeable. Unless some remedial action is taken, the flow of hydrocarbons through the walls of the tunnels can be greatly reduced. Moreover, the damage can inhibit the effectiveness of various stimulation procedures where a treating fluid is to be pumped into the formation under pressure.

As shown in further detail in FIG. 2, the tool 10 includes an oscillator sub or mandrel 20 that has a cavity 21 formed in the upper end portion thereof. A central bore 24 leads to a port 25 which provides the input to the power nozzle 26 of a fluidic oscillator block 27. The block 27 has a downwardly directed flow passage 28 which leads to a pair of diffuser passages 31, 32 that incline downward and outward in opposite directions, and which lead to output ports 33, 34. Feedback passages 35, 36 extend from the respective lower end portions of the diffuser passages 31, 32 back up to control nozzles on the opposite sides of the power nozzle 26. When supplied with fluid that is pumped down the tubing 11 from the surface, the fluid flow from the power nozzle 26 is switched back and forth between the diffuser legs 31, 32 and creates pressure changes in fluid zones that are communicated with the respective outputs 33, 34.

The output ports 33, 34 communicate with respective storage cavities 40, 41 that are formed inside the mandrel 23 below the oscillator block 27. As shown in FIG. 3, each of the cavities 40, 41 is generally cylindrical in form and has pairs of legs 43, 43' and 44, 44' which communicate respectively with external recesses 45 and 46 that are formed in opposite sides of the mandrel 23. The recesses 45, 46 each have a short height, and are defined in part by upper and lower walls 65, 66 (FIG. 2). The recesses 45, 46 are open to the well annulus 48 (FIG. 1) externally of the mandrel 23 and are positioned adjacent the perforations 13 so that a relatively short annulus length L receives short duration pressure pulses generated by the oscillator block 27. These pressure fluctuations are superposed on hydrostatic pressure at tool depth to provide resultant pressures that change rapidly in the nature of a sine wave having peak-to-peak values that are considerably above and below the static head pressure. The well bore volume having approximately the length L is much smaller than has been used in previous perforation cleaning devices, which functions to concentrate the pressure fluctuations where they have their greatest amplitudes in the region 48 immediately adjacent the perforations 13.

Upper and lower acoustic filters indicated generally at 50 and 51 can be used in combination in accordance with another aspect of the present invention to substantially confine the pressure pulsations to that region of the well annulus that is between them. Each of these filters is an elongated hollow tube 52 having a plurality of sets of transverse slots 60 formed through the wall thereof. The upper tube 50 is mounted on a tubular member 53 and the lower tube 54 is mounted on another tubular member 55. The lower end of the member 53, is attached to the upper end of the mandrel 23, and its upper end is threaded by a suitable connection to the lower end of the tubing string 11 as shown in FIG. 1. The upper end of the lower tubular member 54 is threaded to the lower end of the sub 55. Each of the slots 60 of each set are evenly spaced around the circumference of the tubes 52, 54, with each slot extending through an angle of about 90°. An adjacent set of slots 61 are formed in the same fashion, but is angularly offset by about 60°. The slot sets 60 are arranged on an equal, fairly close axial spacing along the length of the respective tubes 52 and 54, and extend substantially throughout such length. Each tube 52, 54 can be mounted so as to be laterally spaced by a substantial clearance by arcuate blocks or the like from the outer walls of the respective mandrels 53, 55. By virtue of the slots 60, each of the tubes 52 and 54 operates as a resistance in the fluid network by restricting fluid flow, which limits the propagation of pressure changes upward and downward in the well bore therepast. The axial position of each filter tube can be adjusted with respect to the recesses 45, 46 by suitable means (not shown) by which they are mounted in order to fine-tune or calibrate the tool 10.

Another embodiment of the present invention is shown in FIG. 4. Here the mandrel 70 of the tool 69 has a relatively small diameter, for example slightly less than 2½" so that it can be lowered through 2⅞" tubing 71 which forms the production string inside the casing 72. A well packer indicated schematically at 73 is used to pack off the annulus between the tubing 71 and the casing 72 so that production flow and pressure is confined to the tubing. The tool 69 also can include upper and lower filter subs 74, 75 which are constructed as previously described, but with substantially the same outer diameter as the mandrel 70. A coupling 76 at the upper end of the filter 74 is used to suspend the tool 69 on the low end of coil tubing 77 which extends upward to the surface where it is reeled onto the spool of a coil tubing unit (not shown). The tool 69 is lowered through the production tubing 71 on the lower end of the coil tubing 77 until it is below the lower end of the tubing and inside the casing 72 adjacent the perforations 78 to be cleaned. Then fluid is pumped down the coil tubing 77 and through an oscillator block formed in the mandrel 70 which creates pressure pulsations or waves which cause alternating compressional and tensional loading to be applied to the walls of the perforations 78 in order to clean the same as described above where the filters 74, 75 are used, the pressure waves are somewhat confined to the annulus surrounding the tool 69. Of course the packer 73 prevents passage of any pressure waves up into the annulus above it.

Other embodiments of oscillator sections or blocks 79 that can be used either with a tubing or a coil tubing conveyed cleaning tool are shown in FIGS. 5–9. In the oscillator shown in FIG. 5 the fluid flow passes through a power nozzle 80 and into the passage therebelow where it is diverted into one of two diffuser passages 81, 82 that incline downward and outward in opposite lateral directions, and which lead to outlet ports 83, 84. The respective axes of the ports are parallel to the longitudinal axis of the block 79, and thus to the inner wall surfaces of the casing 72. Feedback passages 85, 86 extend from the respective lower end portions of the diffuser passages 81, 82 back up to control nozzles on the opposite sides of the power nozzle 80. As fluid is pumped down the coil tubing 77 from the surface, the flow below the nozzle 80 is switched back and forth between the diffuser passages 81, 82 to create alternating pressure fluctuations in the recesses 95, 96 which are open to the annular region of the well bore adjacent thereto. The recesses 95, 96 are similar to those shown in FIG. 3 in that they are formed on opposite sides of a generally rectangular central wall 91, and are defined in part by upper and lower walls 89, 90 as illustrated. The passage of the pressure waves from the outlet ports 83, 84 into the recesses 95, 96, as shown by the arrows, causes concentration thereof in a relatively short length region of the well annulus between the body of the tool and the casing wall where they have their greatest amplitudes.

Figure 5:
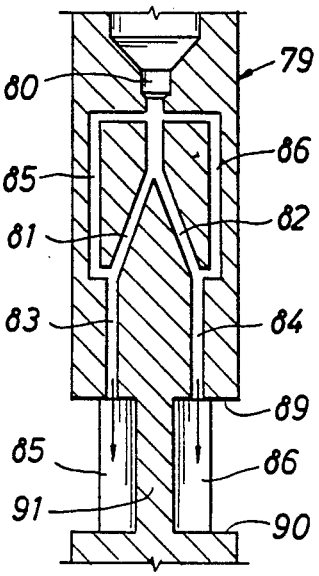
FIGS. 5, 6, 7 and 8 are enlarged views of various alternative embodiments of oscillator sections.
Figure 6:
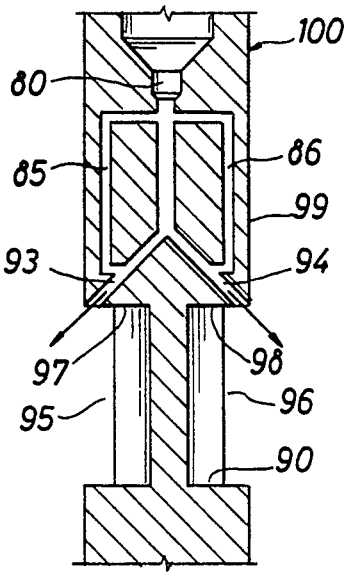

The FIG. 6 embodiment is similar to the construction shown in FIG. 5 except that the lower ends of the diffuser legs 93, 94 open generally downward in the vicinity of the recesses 95 and 96 at points near the intersections of the walls 97, 98 and the outer wall 99 of the oscillator block 100. In a preferred form, the respective centerlines of the legs 93 and 94 are formed at an angle of about 45° to the longitudinal axis of the block 100 so that pressure pulsations enter the well annulus in the directions shown by the arrows which is also about 45° to the inner walls of the casing 72. Other elements shown in FIG. 6 which are the same as corresponding elements in the embodiment shown in FIG. 5 are given the same reference numerals.

Figure 7:
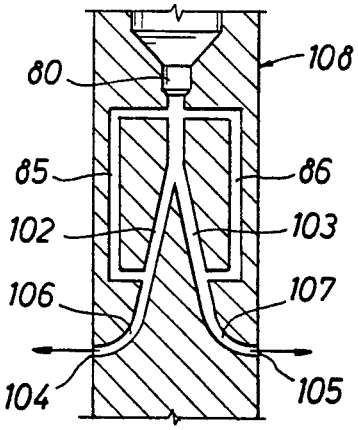

FIG. 7 shows yet another embodiment where the lower ends of the diffuser legs 102, 103 lead to diametrically opposed, radially extending ports 104, 105 by way of curved sections 106, 107. In this manner, the pressure waves are communicated with the well annulus adjacent the perforations in radially outward directions as shown by the arrows, or at angles of 90° with respect to the longitudinal axis of the oscillator block 108, and to the inner walls of the casing 72. Since the pressure waves are directed radially, the oppositely disposed mandrel cavities mentioned above need not be used, although they can be if desired.

Figure 8:
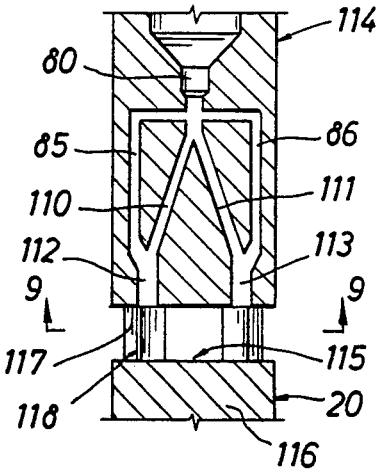
Figure 9:
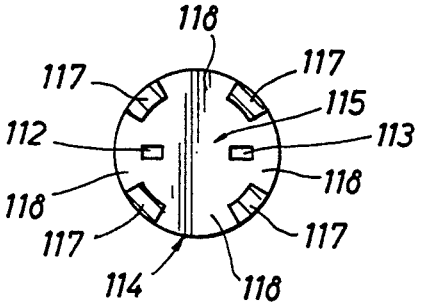
FIG. 9 is a cross-section on line 9—9 of FIG. 8.

FIG. 8 shows another configuration where the diffuser legs 110, 111 extend downward to outlet ports 112, 113 whose centerlines are parallel to the longitudinal axis of the oscillator block 114. The ports 112, 113 open downward into a confined region 115 between the lower end of the block 114 and the upper end of a portion 116 of the tool body 20. The portion 116 is connected to the block 114 by a plurality of angularly spaced legs 117 in a manner such that openings or windows 118 (FIG. 9) are provided to communicate the pressure pulses to the well bore.

OPERATION

In operation, the cleaning tool 10 shown in FIGS. 1–3 is connected to the lower end of the tubing string 11 and lowered into the well until the storage cavities 40, 41 are opposite perforations 13 to be cleaned. Surface pumps (not shown) are used to pump fluid down the tubing 11 at a selected rate that will provide resonant frequency operation of the tool 10. The fluid returns to the surface through the annulus between the tubing 11 and the casing 12. The oscillator block 27 operates to apply alternating pressure pulses to the cavities 40, 41 via the outlets 33, 34, and from the cavities the pulses are applied to the annular volume of fluid outside the body by the outlet ports 43, 43' and 44, 44'. By way of a typical example, the pressure in the annulus region 48 can be fluctuated between peak-to-peak values having a difference of about 2,000 psi. Where the hydrostatic head pressure is 2,500 psi, the pressures in the region 40 will vary between about 3,500 psi and about 1,500 psi. A typical frequency can be about 150 $H_z$.

The walls of the perforation 13 are subjected to such pressure changes, which induce cyclical tension and compressive stresses therein. The impermeable skin rapidly breaks down and disintegrates, and the debris can be removed by fluid circulation. The perforations 13 are thus cleaned out, and the productivity index of the formation is greatly increased. The time that the cleaning tool 10 should be left in operation adjacent a group of perforations 13 depends on the type of formation, with weaker rocks such as limestone needing less cleaning time than stronger rocks such as dolomite. When the perforations break down this can be readily observed at the surface by monitoring pressure gauges.

The filter tubes 50 and 51 function to provide a resistance to fluid movement that confines the changing pressures to a length of the well bore that is from about midway of the upper tube to about midway of the lower tube. These filters thus further concentrate the pressure changes to the cleaning zone, and substantially prevent transmission of acoustic waves up or down hole from the tool 10. To enhance the efficiency of the tool 10, the filter tubes can be adjusted up or down along their respective mandrels 53, 55 prior to running the tool into the well in order to fine-tune or calibrate the tool.

Since the pressure fluctuations are applied to a small volume having a short length L compared to previous devices, the intensity of the fluctuations is magnified in this region to produce optimum cleaning. By varying the sizes of the two storage cavities 40, 41, it is possible to release pulses into the well annulus simultaneously, causing a much stronger pressure pulse, however the frequency will be reduced. Whether the pulsating pressures are applied simultaneously or not, they are contained in the cleaning region by the filters 47, 48 to allow the tool to operate a maximum efficiency.

The operation of the coil tubing-conveyed cleaning tool 69 shown in FIGS. 4 and 5 is substantially the same as that described above. The tool 69 has the advantage that the production string of tubing 71 need not be pulled for a cleaning operation to be performed. The various embodiments of the oscillator units shown in FIGS. 5–9 have similar operating characteristics, however the angle at which the pressure waves are injected into the casing annulus region surrounding the tool can be varied by using a selected embodiment. Selected ones of these embodiments can be used with the cleaning tool 69 or the cleaning tool 10 to achieve optimum cleaning of the perforations.

It now will be recognized that new and improved perforation cleaning tools which meet the objectives and have all the features and advantages specified herein. Since certain changes or modifications may be made in the disclosed embodiments without departing from the inventive concepts involved, it is the aim of the following claims to cover all such changes and modifications that fall within the true spirit and scope of the present invention.

What is claimed is:

1. A well tool for use in cleaning a perforation that communicates a well bore with a formation, said well tool having an elongated tubular body that is adapted to be lowered into a well on a running-in string, comprising: fluidic oscillator means in said body having first and second outlets, said oscillator means being responsive to the flow of fluids in said running-in string for creating alternating pressure pulses at said first and second outlets; first and second cavity means in said body in communication respectively with said first and second outlets; passage means for communicating each of said cavity means with the annular well bore region externally of said body and said cavity means; and filter means mounted adjacent the respective upper and lower ends of said body for substantially confining said pressure variations to said annular region and for substantially isolating the well bore above and below said filter means from said pressure pulses.

2. The well tool of claim 1 wherein each of said passage means includes a pair of flow channels that extend from opposite sides of a respective cavity means to the exterior of said body.

3. The well tool of claim 2 wherein said body includes recessed regions on opposite sides thereof, said flow channels opening into said recessed regions.

4. The well tool of claim 3 wherein each recessed region has a pair of inner walls formed at a right angle to one another; said flow channels opening perpendicularly through each of said inner walls.

5. The well tool of claim 4 wherein said flow channels are all formed in a single transverse plane in said body.

6. The well tool of claim 1 wherein each of said filter means comprises an elongated tube having a plurality of axially spaced slots through the walls thereof.

7. The well tool of claim 6 further including means for adjusting the axial spacing of said upper and lower filter means with respect to one another.

8. The well tool of claim 1 wherein said running-in string is a string of tubing having individual joints that are connected end-to-end, and means for coupling said filter means at the upper end of said body to the lower joint of said string of tubing.

9. The well tool of claim 1 wherein said running-in string is a length of coil tubing, and means for coupling said filter means at the upper end of said body to the lower end of said coil tubing.

10. In a well tool for use in cleaning a perforation that communicates a formation with a well bore inside a casing, said well tool having an elongated tubular body that is adapted to be lowered into the well bore on a running-in string, a fluidic oscillator apparatus including a generally cylindrical mandrel having a longitudinal axis and defining a power nozzle, a pair of diffuser legs, an outlet port communicating with each of said diffuser legs, feedback flow passages for switching the flow of fluid coming out of said power nozzle to alternating ones of said diffuser legs and outlet ports to generate pressure pulsations, recess means formed in said mandrel below said outlet ports and being in fluid communication therewith so that said pressure pulsations are applied to said recess means, and means for communicating said recess means with the well bore, said communicating means being constructed and arranged such that said pressure pulsations pass into said well bore in substantially radially outward directions with respect to said longitudinal axis of said mandrel.

11. The apparatus of claim 10 wherein said communicating means are formed by means providing windows in the outer periphery of said recess means.

12. The apparatus of claim 10 wherein said communicating means are formed by means defining open areas on the outer sides of said recess means.

13. The apparatus of claim 10 wherein said recess means includes elongated storage cavity means in said body in communication with each of said outlet ports, and further including additional port means for communicating each of said storage cavity means with said recess means.

14. In a well tool for use in cleaning a perforation that communicates a formation with a well bore inside a casing, said well tool having an elongated, generally cylindrical body having a longitudinal axis and adapted to be lowered into the well bore on a running-in string, a fluidic oscillator means mounted in said body and defining a power nozzle, a pair of diffuser legs, an outlet port communicating with each of said diffuser legs, feedback flow passages for switching the flow of fluid coming out of said power nozzle to alternating ones of said diffuser legs and outlet ports to generate pressure pulsations, and recess means defined in part by wall sections of said body for communicating said pressure pulsations to the well annulus surrounding said body, said wall sections including a plurality of leg members angularly spaced about said longitudinal axis.

15. The apparatus of claim 14 wherein each of said wall sections provides opposed wall surfaces that extend generally radially outward of said longitudinal axis.

* * * * *